US006220971B1

(12) United States Patent
Takeda

(10) Patent No.: US 6,220,971 B1
(45) Date of Patent: Apr. 24, 2001

(54) GOLF CLUB AND METHOD OF MANUFACTURING SAME

(75) Inventor: Hitoshi Takeda, Tsubame (JP)

(73) Assignee: K.K. Endo Seisakusho, Niigata (JP)

( * ) Notice: Subject to any disclaimer, the term of this patent is extended or adjusted under 35 U.S.C. 154(b) by 0 days.

(21) Appl. No.: 09/366,813

(22) Filed: Aug. 4, 1999

(30) Foreign Application Priority Data

Mar. 30, 1999 (JP) ..... 11-090185

(51) Int. Cl.[7] ..... A63B 53/04

(52) U.S. Cl. ..... 473/342; 473/345; 473/350; 473/409

(58) Field of Search ..... 473/342, 350, 473/334, 349, 409, 324

(56) References Cited

U.S. PATENT DOCUMENTS 5,522,593 * 6/1996 Kobayashi et al. ..... 473/349

FOREIGN PATENT DOCUMENTS 2560272 9/1996 (JP) .
2605253 2/1997 (JP) .
9-276453 10/1997 (JP) .

* cited by examiner

*Primary Examiner*—Sebastiano Passaniti
*Assistant Examiner*—Sneh Varma
(74) *Attorney, Agent, or Firm*—Jordan and Hamburg LLP

(57) ABSTRACT

A golf club including a golf club head having a head body and a face member. The head body is formed with a cavity portion opening to a face on the front face, and a window opening cut out of a rear side inside the cavity portion. A face member formed from a plate-like metallic material is arranged at least partially in the cavity portion. A first connection recess is formed in the cavity portion and a second connection recess is formed in a portion of the face member facing the first connection recess. A fixing member is arranged between the first and second connection recesses, and the fixing member is plastically deformed and pressed into the first and second connection recesses. As a result, the face member can be reliably secured to the head body. When the window opening is "under cut", a protrusion thus formed will not be susceptible to bending back away from the face member.

17 Claims, 6 Drawing Sheets

GOLF CLUB AND METHOD OF MANUFACTURING SAME

BACKGROUND OF THE INVENTION

The present invention relates to a golf club and a method of manufacturing the same.

In the prior art, Japanese Patent No. 2602253, by the same applicant, describes a golfing iron club head formed by fixing a plurality of members while subjecting them to plastic deformation. This golfing iron club head comprises, as shown for example in FIG. 1 of the above publication, a face member, a weight member provided on a rear surface of the face member, a first cavity portion formed in a rear surface of the face member with a peripheral face in a reverse tapered shape, a second cavity portion formed in a front surface of the weight member opposite to the first cavity portion with a peripheral face in a reverse tapered shape, and a connecting member such as an adhesive or carbon fiber filled and solidified between the first cavity portion and the second cavity portion. In this manner, the face member and the weight member may comprise different materials but are integrally and securely connected to one another.

Also, in the prior art, for such heads, materials having relatively low proof stress and which are easily plastically deformed, such as pure titanium, iron, stainless steel, copper and the like have been used. To obtain higher performance however, the adoption of high-strength materials such as titanium alloy, amorphous alloy and marageing steel has recently been studied. These high-strength materials have a problem in that they are not easily plastically deformed because they have high proof stress and large spring back, and are susceptible to deformation. As a result, in the case of members using high-strength materials, there are problems in that the connection strength is weak, and there is a gap between both members, which is undesirable from an appearance point of view. Specifically, in the case where a face member is fitted to a head body having a window opening as described in Japanese Patent No. 2560272, there is a problem in that the edge of the window opening tends to be bent back at the time of pressing.

One means for solving these problems is adhesion. However, adhesion is not sufficiently strong. Moreover, the method used with the golf club head disclosed in Japanese Patent No. 2560272 by the same applicant is also known. This golf club head as shown in FIG. 1 of the above publication, is one which is provided with a face on a front surface and a shaft connecting portion on one side, and comprises a head body formed with a sole, a cavity portion corresponding to the face formed in the front surface, a through hole formed in the cavity portion and directed rearward and a face member formed from a plate-like metallic material having a lower specific gravity than the head body and fitted into the cavity portion. The cavity portion is formed in a reverse tapered shape, and the face member is pressed into the cavity portion using a press, so that the face member is secured to the cavity portion. Furthermore, Japanese Unexamined Patent Publication No. Hei 9-276453 by the same applicant discloses a manufacturing method for a golf club head comprising a head body having a face, and a weight secured to a rear side of the head body, wherein there is formed a plurality of threaded holes respectively facing the head body and the weight, and the weight is secured while plastically deforming opposite ends of a fixing member in the facing threaded holes.

Utilizing the fixing means disclosed in the above-mentioned Japanese Patent No. 2605253 and Japanese Unexamined Patent Publication No. Hei 9-276453 has been considered. However, it is not possible to secure the face member as described in these publications to a head body having a window opening as in the above-mentioned Japanese Patent No. 2560272.

SUMMARY OF THE INVENTION

It is therefore an object of the present invention to be able to reliably secure together each member in a golf club head formed from a plurality of members.

According to a first embodiment of the present invention there is provided a golf club with a head provided with a face on a front surface and a shaft connecting portion on one side, and a shaft connected to the shaft connecting portion. The head, which is formed by integrally connecting a plurality of members, is provided with connection recesses in portions where the plurality of members face each other. At least one of the connection recesses is formed in a reverse tapered shape. A fixing member is arranged between facing connection recesses, and the fixing member is plastically deformed so as to be pressed into the connection recesses, to thereby secure the facing members together.

In the first embodiment, by attaching the connecting member between the connection recesses by pressing thereinto, facing members of the head can be reliably secured to each other.

According to a second embodiment of the present invention, there is provided a golf club with a head provided with a face on a front surface and a shaft connecting portion on one side, and a shaft connected to the shaft connecting portion, the head, which is formed by integrally connecting a plurality of members, is provided with connection recesses in portions where the plurality of members face each other. Irregularities are formed on a peripheral face of at least one of the connection recesses. A fixing member is arranged between facing connection recesses, and the fixing member is plastically deformed so as to be pressed into the connection recesses, to thereby secure the facing members.

In the second embodiment, by attaching the connecting member between the connection recesses by pressing thereinto, facing members of the head can be reliably secured to each other.

According to a third embodiment of the present invention, there is provided a golfing iron club with a head provided with a face on a front surface and a shaft connecting portion on one side, and a shaft connected to the shaft connecting portion, the head comprising a head body formed with a sole, a cavity portion corresponding to the face formed in a front surface, a window opening formed inside the cavity portion and passing through to a rear surface side and a face member formed from a plate-like metallic material and fitted into the cavity portion. Further, a first connection recess is formed in the cavity portion, a second connection recess is formed in a portion of the face member facing the first connection recess, and a fixing member is arranged between the first and the second connection recesses, and the fixing member is plastically deformed so as to be pressed into the first and the second connection recesses, to thereby secure the face member to the head body.

In the third embodiment, the face member can be fitted into the cavity portion on the head body, and a desired location in the cavity portion and a desired location in the face member can be reliably secured together.

According to a fourth embodiment of the present invention, there is provided a method of manufacturing a golfing iron club with a head provided with a face on a front surface and a shaft connecting portion on one side, and a shaft connected to the shaft connecting portion, the head comprising a head body formed with a sole, a cavity portion corresponding to the face formed in a front surface, a window opening formed inside the cavity portion and passing through to a rear surface side and a face member formed from a plate-like metallic material and fitted into the cavity portion. Further, a first connection recess is formed in the cavity portion, a second connection recess is formed in a portion of the face member facing the first connection recess, and the face member is pressed into the cavity portion, and at the time of the pressing, a fixing billet is arranged between the first and the second connection recesses and the fixing billet is plastically deformed so as to be pressed into the first and the second connection recesses, to thereby secure the face member to the head body.

In the fourth embodiment, the fixing billet is plastically deformed at the time of pressingly inserting the face member, so as to be fitted into the first and the second connection recesses.

BRIEF DESCRIPTION OF THE DRAWINGS

Other objects, features and advantages of the invention will become apparent to those skilled in the art, from the following description of the preferred embodiments of the invention, wherein reference is made to the accompanying drawings, in which:

FIG. 1A is a cross-sectional view of a first embodiment of the present invention, while

FIG. 4A is a cross-sectional view of a second embodiment of the present invention, while

DETAILED DESCRIPTION

Figure 1A:
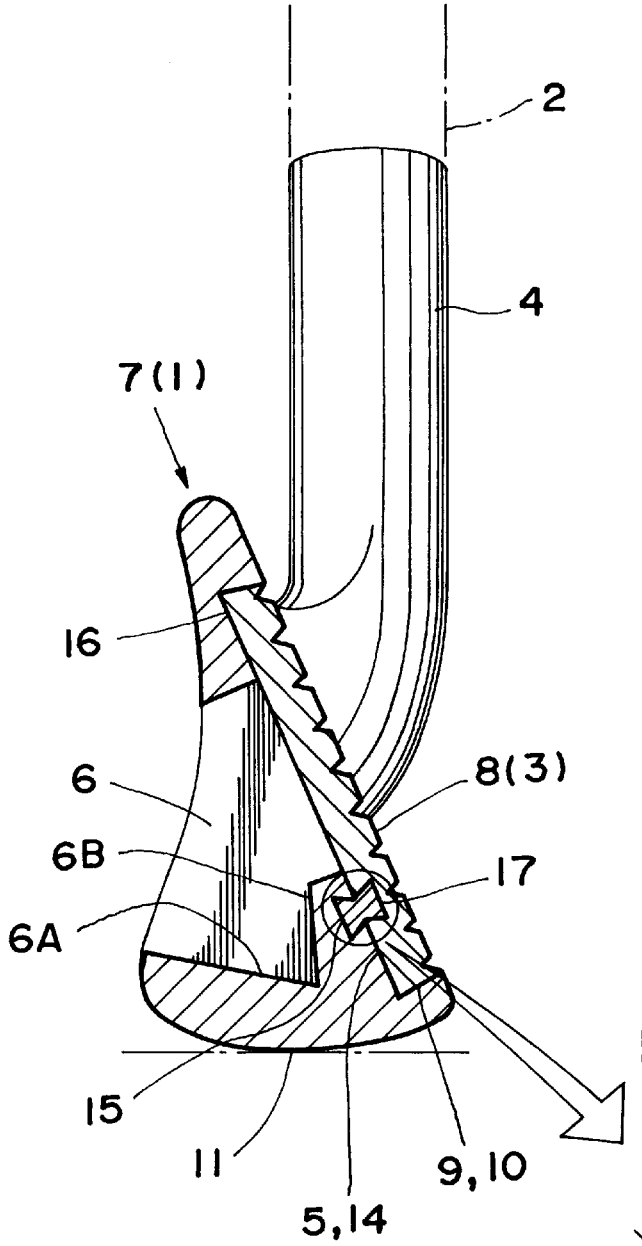
Figure 1B:
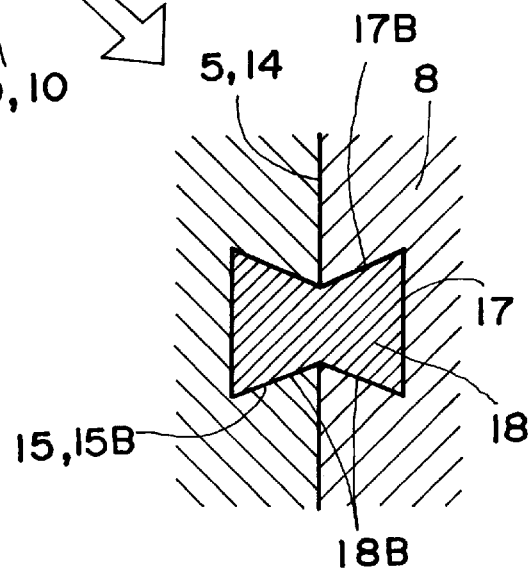
FIG. 1B is a partially enlarged cross-sectional view thereof.
Figure 2:
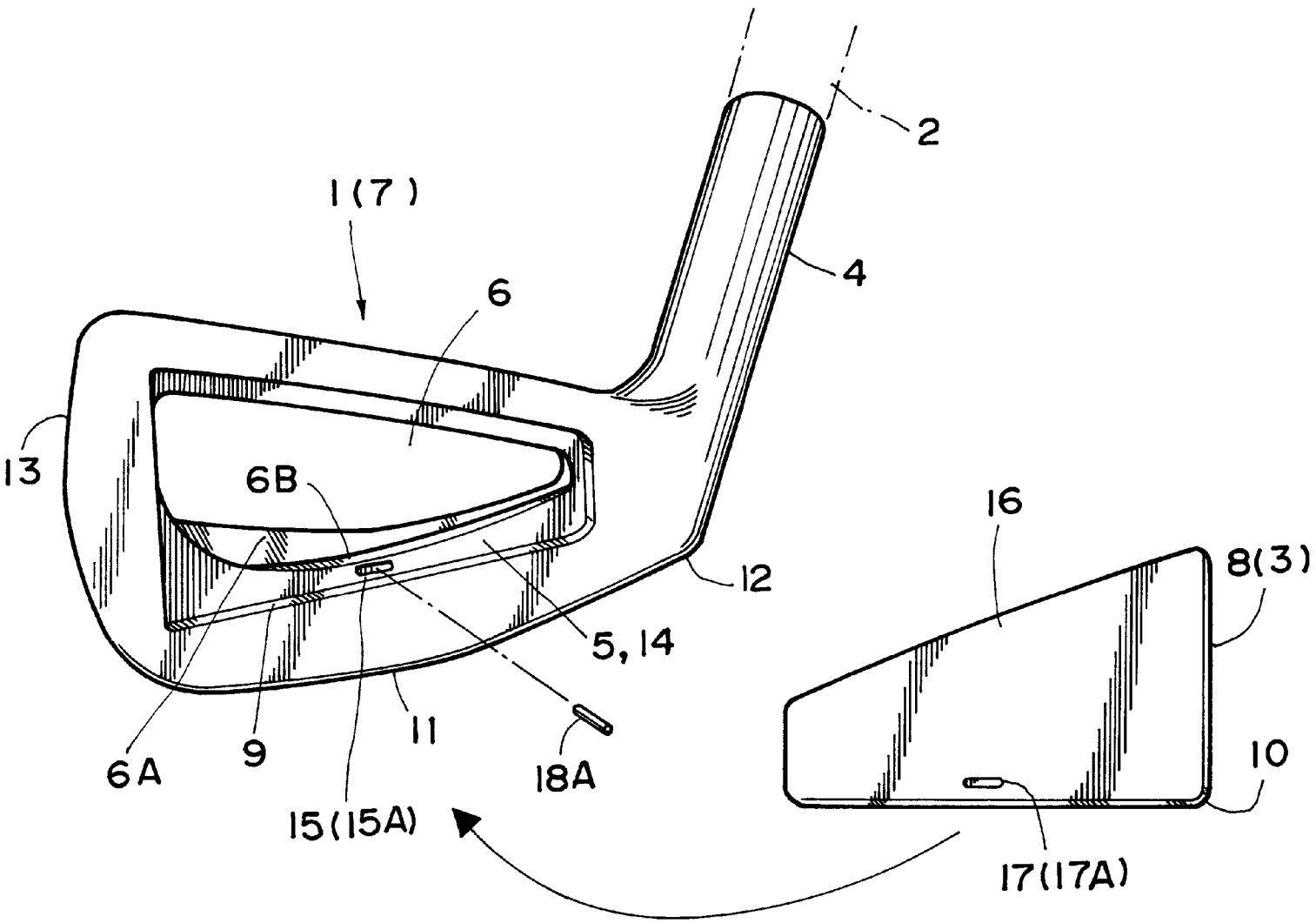
FIG. 2 is an exploded perspective view of the first embodiment of the present invention.
Figure 3:
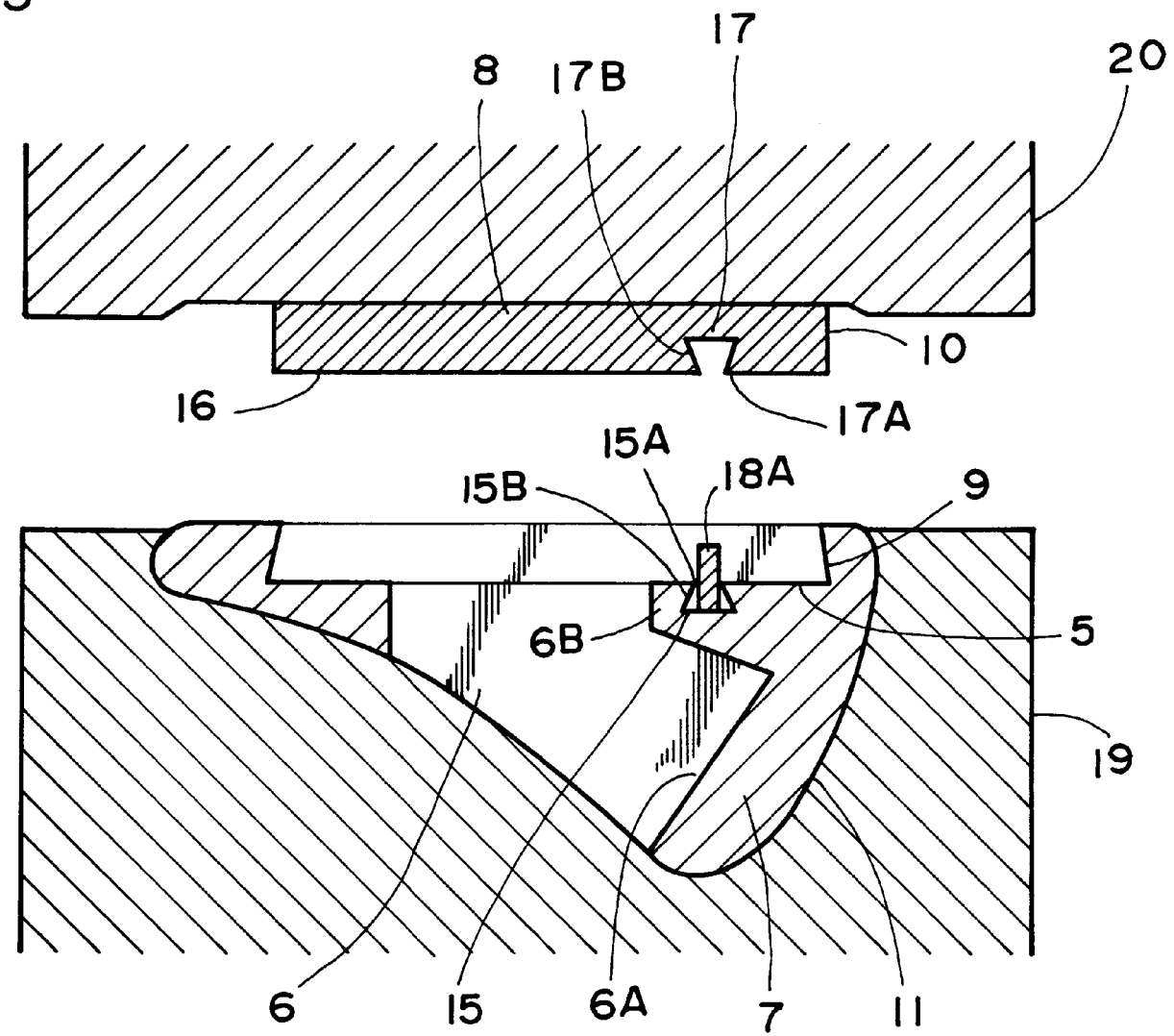
FIG. 3 is a cross-sectional view at the time of manufacturing, illustrating the first embodiment of the present invention.

A description of embodiments of the present invention is set forth below with reference to the appended drawings. As shown in FIG. 1 through FIG. 3, a golf club comprises a head 1 and a shaft 2. The head 1 is provided on a front surface with a face 3 for striking a golf ball, and on one side with a shaft connecting portion 4 for connecting the shaft 2. The head 1 comprises: a head body 7 being a first constituent member of the head 1, which is made of stainless steel such as SUS 304, and which is formed with a cavity portion 5 corresponding to the face 3, and a window opening 6 in the cavity portion 5 opening toward the rear, and which is provided with the shaft connecting portion 4 on one side; and a face member 8 being a plate-like second constituent member of the head 1, set into the cavity portion 5 and made of a high-strength metal such as a titanium alloy containing 15% of vanadium, 3% of aluminum, 3% of tin, and 3% of chromium, being a so-called 15.3.3.3 β-titanium alloy type, or the like. A peripheral face 9 of the cavity portion 5 is formed in a reverse tapered shape, expanding rearward, and a peripheral face 10 of the face member 8 is formed slightly larger than the peripheral face 9. By pressing the face member 8 into the cavity portion 5, plastic deformation is caused between the face member 8 and the cavity portion 5, to thereby secure the two members together. Moreover, a bottom portion 6A on a side of the cavity portion 5 including a sole 11 (hereinafter referred to as the sole side) is deeply gouged and formed in a so-called "under cut" shape. Therefore, on the front part of the bottom portion 6A is formed, as well as a protrusion 6B provided in a protruding condition on a rear surface 16 of the face member 8. In addition, in the figures, numeral 12 denotes a heel, and 13 denotes a toe, and the longitudinal width of the cavity portion 5 is formed gradually expanding from the heel 12 toward the toe 13.

Moreover, in the sole side of a rear surface 14 of the cavity portion 5, that is, in the front surface of the protrusion 6B, there is formed a first connection recess 15. Furthermore, in a portion on the rear surface 16 of the face member 8 opposite to the first connection recess 15 there is formed a second connection recess 17. The first connection recess 15 has a lateral width of an opening 15A of not larger than 20 mm, preferably about 10 mm, and a longitudinal width of about 10 mm, preferably about 5 mm, and a peripheral face 15B in the section is formed in a reverse tapered shape so that the longitudinal width and/or the lateral width gradually expands rearward. Likewise, the second connection recess 17 has a lateral width of an opening 17A of not larger than 20 mm, preferably about 10 mm, and a longitudinal width of about 10 mm, preferably about 5 mm, and a peripheral face 17B in the section is formed in a reverse tapered shape so that the longitudinal width and/or the lateral width gradually expands forward. Between the first and the second connection recesses 15 and 17, there is fitted a fixing member 18 made of a material such as copper which easily undergoes plastic forming, that is, which has a smaller longitudinal elastic modulus or Young's modulus than that of the head body 7 or the face member 8. Fitting of the fixing member 18 is performed by arranging a cylindrical shaped fixing billet 18A between the first connection recess 15 and the second connection recess 17, and subjecting the fixing billet 18A to plastic deformation at the time of pressing the face member 8 into the cavity portion 5, so as to be pressed into both the first and the second connection recesses 15 and 17 in a reverse tapered shape. The fixing billet 18A is sized so as to be able to be respectively inserted into the openings 15A and 17A of the first and second connection recesses 15 and 17, and so that the volume thereof is substantially the same as or slightly smaller than the volume of the first and second connection recesses 15 and 17.

Next is a description of the manufacturing method, with particular reference being made to FIG. 3. The head body 7 is set in a lower die 19 which is one die, and the fixing billet 18A is set in the first connection recess 15. Then the face member 8 is set so that the face member 8 faces the cavity portion 5 and the second connection recess 17 faces the fixing billet 18A. When the face member 8 is pressed by a press apparatus using an upper die 20 which is the other die, the peripheral face 10 is pressed in along the peripheral face 9, while being plastically deformed, and the peripheral face 10 is formed into a reverse tapered shape. At the same time, the fixing billet 18A is plastically deformed along the first and second connection recesses 15 and 17, with peripheral faces 18B on both sides being pressed into reverse tapered shapes sharing the rear surface 14 of the cavity portion 5 as a border.

As a result, the peripheral face 10 is plastically deformed and pressed in alone, the peripheral face 9 in a reverse tapered shape by pressing so that the face member 8 is secured to the cavity portion 5 with the reverse tapered shape. At the same time, the peripheral faces 18B of the fixing billet 18A are pressed while being plastically deformed along the first and second connection recesses 15 and 17 into reverse tapered shapes. As a result, the sole side of the rear surface 14 of the cavity portion 5 and the lower part of the rear surface 16 of the face member 8 can be tightly secured together. Thus, by securing together with the fixing member 18, the sole side of the rear surface 14 and the protrusion 6B formed adjacent the lower part of the rear surface 16 of the face member 8, then the bending back of the protrusion 6B located on the front part of the under-cut window opening 6 can be prevented.

With the embodiment as described above, with the golf club with the head 1 provided with the face 3 on the front surface and the shaft connecting portion 4 on one side, and the shaft 2 connected to the shaft connecting portion 4, the head 1 which is formed by integrally connecting the head body 7 being the first constituent member of the head 1, and the face member 8 being the second constituent member of the head 1, is provided with reverse tapered shape connection recesses 15 and 17 in respective portions where the head body 7 and the face member 8 face each other. That is, connection recesses 15 and 17 are situated in the protrusion 6B and in the rear surface 16 of the face member 8. The fixing member 18 is arranged between the facing connection recesses 15 and 17, and the fixing member 18 is plastically deformed so as to be pressed into the connection recesses 15 and 17, to thereby secure the head body 7 to the face member 8. Hence, the face member 8 comprising a high-strength material can be reliably secured to the head body 7.

Moreover, the head 1 comprises: the head body 7 formed with the sole 11, the cavity portion 5 corresponding to the face 3 formed in the front surface, the window opening 6 formed inside the cavity portion 5 and passing through to the rear surface side and the face member 8 formed from the plate-like metallic material and fitted into the cavity portion 5, and the first connection recess 15 is formed in the cavity portion 5, the second connection recess 17 is formed in the portion of the face member 9 facing the first connection recess 15. The fixing member 18 is arranged between the first and second connection recesses 15 and 17, and the fixing member 18 is plastically deformed so as to be pressed into the first and the second connection recesses 15 and 17, to thereby secure the face member 8 to the head body 7. Hence, the face member 8 comprising a high-strength material can be reliably secured to the head body 7. Moreover, by forming the first connection recess 15 in the protrusion 6B located on the front part of the window opening 6, the protrusion 6B will not be bent back, even if the window opening 6 is "under-cut". As a result, the face member 8 and the head body 7 can be reliably secured together.

Furthermore, the head 1 comprises the head body 7 formed with the sole 11, the cavity portion 5 corresponding to the face 3 formed in the front surface, the window opening 6 formed inside the cavity portion 5 and passing through to the rear surface side and the face member 8 formed from the plate-like metallic material and fitted into the cavity portion 5, and the first connection recess 15 is formed in the cavity portion 5, the second connection recess 17 is formed in the portion of the face member 8 facing the first connection recess 15, and the face member 8 is pressed into the cavity portion 5. At the time of the pressing, the fixing billet 18A is arranged between the first and second connection recesses 15 and 17 and the fixing billet 18A is plastically deformed so as to be pressed into the first and second connection recesses 15 and 17, to thereby secure the face member 8 to the head body 7. As a result, by a single press operation, the peripheral face 10 of the face member 8 can be secured to the peripheral face 9 of the cavity portion 5, and the bottom face 14 of the cavity portion 5 and the rear surface 16 of the face member 8 can be reliably secured together by the fixing member 18.

Figure 4A:
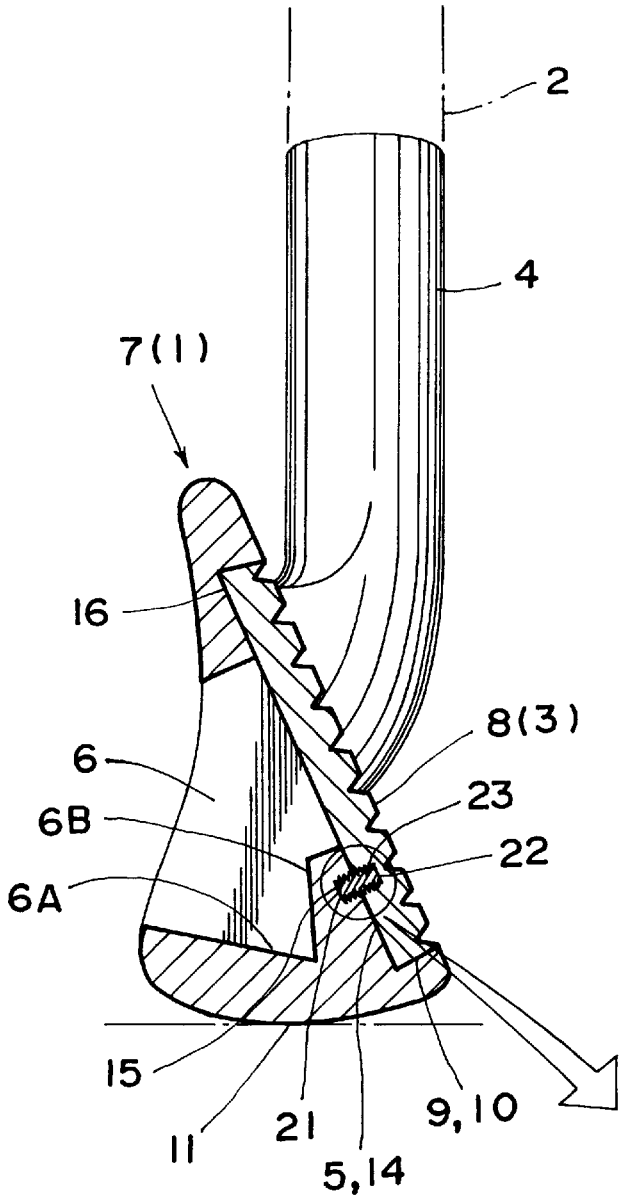
Figure 4B:
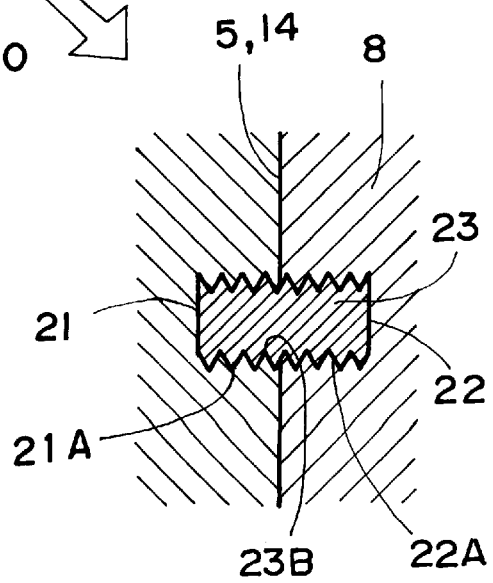
FIG. 4B is a partially enlarged cross-sectional view thereof.
Figure 5:
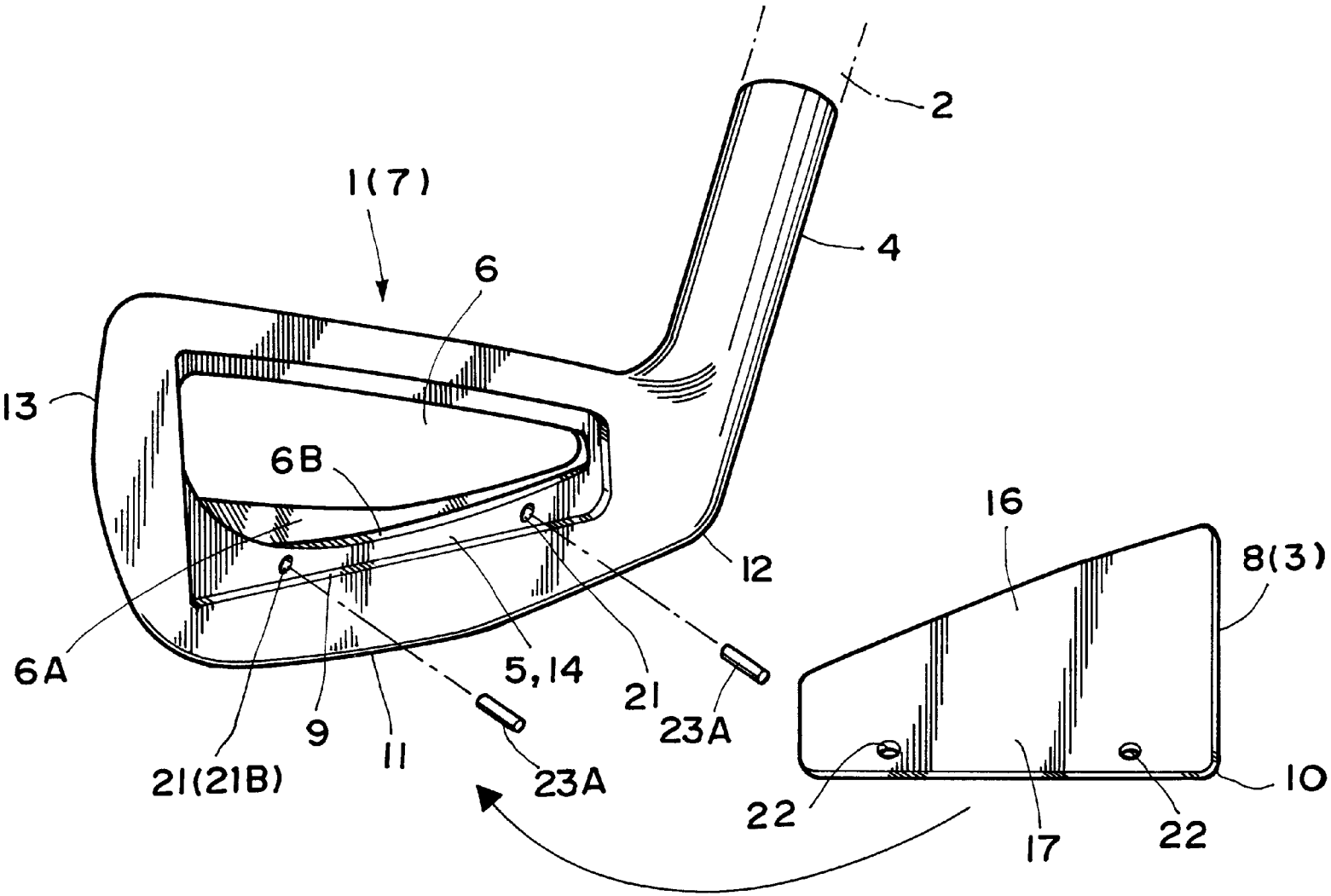
FIG. 5 is an exploded perspective view of the second embodiment of the present invention.
Figure 6:
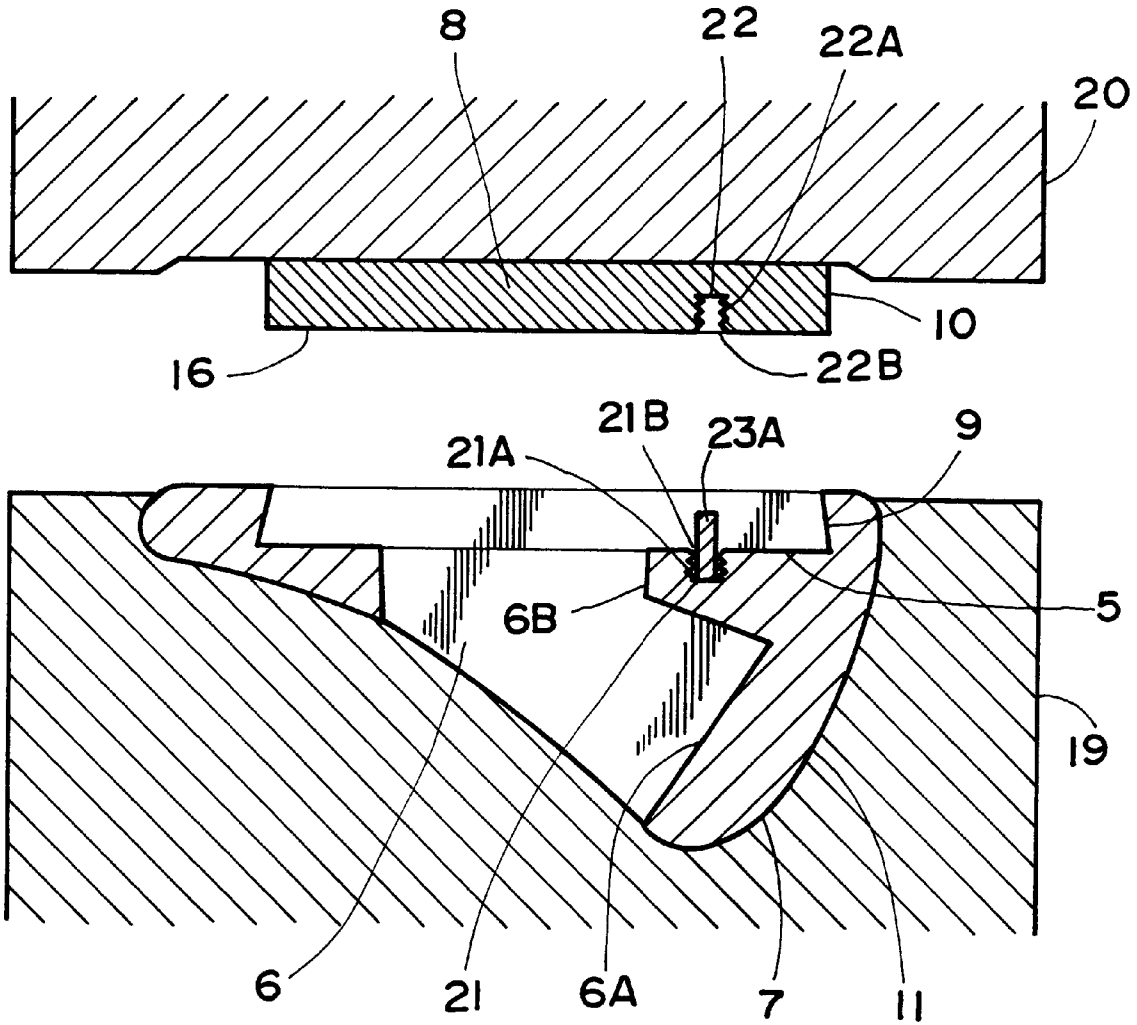
FIG. 6 is a cross-sectional view at the time of manufacturing, illustrating the second embodiment of the present invention.

With reference to FIGS. 4–6, a second embodiment of the present invention will be described. Components corresponding to the components of the first embodiment are denoted by the same symbols, and the details thereof are omitted. With the second embodiment, first connection recesses 21 are provided in left and right sides of a bottom portion of a rear surface 14 of a cavity portion 5, and second connection recesses 22 are provided in portions on a rear surface 16 of a face member 8 opposite to the first connection recesses 21. The first and second connection recesses 21 and 22 are respectively formed with irregularities on their peripheral faces 21A and 22A. Specifically, the first and second connection recesses 21 and 22 are formed with a female threads. A peripheral face 23B of a fixing member 23 provided between the first and second connection recesses 21 and 22 is pressed into the irregularities formed alone, the peripheral faces 21A and 22A.

Next is a description of the manufacturing method, with particular reference being made to FIG. 6. A head body 7 is set in a lower die 19 which is one die, and fixing billets 23A are set in the first connection recesses 21. The fixing billets 23A are round bar shape as with the first embodiment or male threaded rods, and opposite ends thereof are formed in a size which can be inserted into the openings 21B and 22B of the first and second connection recesses 21 and 22. The face member 8 is then set so that the face member 8 faces the cavity portion 5 and the second connection recesses 22 face the fixing billets 23A. When the face member 8 is pressed by a press apparatus using an upper die 20 which is the other die, a peripheral face 10 is pressed in along a peripheral face 9, while being plastically deformed, and the peripheral face 10 is formed into a reverse tapered shape. At the same time, the fixing billets 23A are plastically deformed alone, the first and second connection recesses 15 and 17 so that respective irregular shapes are formed on the peripheral faces on both sides, sharing the rear surface 14 of the cavity portion 5 as a border.

With the embodiment as described above, with the golf club with a head 1 provided with a face 3 on the front surface and the shaft connecting portion 4 on one side, and the shaft 2 connected to the shaft connecting portion 4, the head 1 which is formed by integrally connecting the head body 7 and the face member 8, is provided with the first connection recesses 21 on the head body 7, and the second connection recesses 22 on the face member 8, and irregularities are formed on the peripheral faces 21A and 22A of the first and second connection recesses 21 and 22. The fixing members 23 are arranged between the facing connection recesses 15 and 17, and the fixing members 23 are plastically deformed so as to be pressed into the first and second connection recesses 21 and 22, to thereby secure the head body 7 and the face member 8 together. Hence, the face member 8 comprising a high-strength material can be reliably secured to the head body 7.

Furthermore, the head 1 comprises the head body 7 formed with a sole 11, the cavity portion 5 corresponding to the face 3 formed in a front surface, a window opening 6 formed inside the cavity portion 5 and passing through to a rear surface side and the face member 8 formed from a plate-like metallic material and fitted into the cavity portion 5, and the first connection recesses 21 are formed in the cavity portion 5, the second connection recesses 22 are formed in portions of the face member 8 facing the first connection recesses 21. Further, the fixing members 23 are arranged between the first and the second connection recesses 21 and 22, and the fixing members 23 are plastically deformed so as to be pressed into the first and the second connection recesses 21 and 22, to thereby secure the face member 8 to the head body 7. As a result, the face member 8 comprising a high-strength material can be reliably secured to the head body 7. Moreover, by forming the first connection recesses 21 in the protrusion 6B located on the front part of the window openine, 6, the protrusion 6B will not be bent back, even if the window opening 6 is "undercut". Hence, the face member 8 and the head body 7 can be reliably secured together.

Furthermore, the head 1 comprises the head body 7 formed with the sole 11, the cavity portion 5 corresponding to the face 3 formed in the front surface, the window opening 6 formed inside the cavity portion 5 and passing through to the rear surface side and the face member 8 formed from a plate-like metallic material and fitted into the cavity portion 5, and the first connection recesses 21 are formed in the cavity portion 5, the second connection recesses 22 are formed in the portions of the face member 8 facing the first connection recesses 21, and the face member 8 is pressed into the cavity portion 5. At the time of the pressing, the fixing billets 23A are arranged between the first and second connection recesses 21 and 22 and the fixing billets 23A are plastically deformed so as to be pressed into the first and second connection recesses 21 and 22, to thereby secure the face member 8 to the head body 7. As a result, by a single press operation, the peripheral face 10 of the face member 8 can be secured to the peripheral face 9,of the cavity portion 5 and the bottom face 14 of the cavity portion 5 and the rear surface 16 of the face member 8 can be reliably secured together by the fixing member 23.

The present invention is not limited to the above-described embodiments, but also encompasses various modifications within the scope of the present invention. For example with the first embodiment, either one of the first and second connection recesses 15 and 17 may be formed in a reverse tapered shape, and with the second embodiment, either one of the first and second connection recesses 21 and 22 may be formed with irregularities. Moreover, with the first embodiment the first and second connection recesses 15 and 17 are formed in one place. However, these may be formed in a plurality of places.

According to the first embodiment of the present invention, there is provided there is provided a golf club with a head provided with a face on a front surface and a shaft connecting portion on one side, and a shaft connected to the shaft connecting portion, the head which is formed by integrally connecting a plurality of members, is provided with connection recesses in portions where the plurality of members face each other, at least one of the connection recesses being formed in a reverse tapered shape. Further, the golf club includes a fixing member arranged between facing connection recesses, and the fixing member is plastically deformed so as to be pressed into the connection recesses, to thereby secure the facing members together. By attaching the connecting member between the connection recesses by pressing thereinto, facing members of the head which comprise different materials can be reliably secured to each other.

According to the second embodiment of the present invention, there is provided a golf club with a head provided with a face on a front surface and a shaft connecting portion on one side, and a shaft connected to the shaft connecting portion, the head which is formed by integrally connecting a plurality of members, is provided with connection recesses in portions where the plurality of members face each other, and irregularities are formed on a peripheral face of at least one of the connection recesses. A fixing member is arranged between facing connection recesses, and the fixing member is plastically deformed so as to be pressed into the connection recesses, to thereby secure the facing members. By attaching the connecting member between the connection recesses by pressing thereinto, facing members of the head which comprise different materials can be reliably secured to each other.

According to the third embodiment of the present invention, there is provided a golfing iron club with a head provided with a face on a front surface and a shaft connecting portion on one side, and a shaft connected to the shaft connecting portion, the head comprising a head body formed with a sole, a cavity portion corresponding to the face formed in a front surface, a window opening formed inside the cavity portion and passing through to a rear surface side and a face member formed from a plate-like metallic material and fitted into the cavity portion. A first connection recess is formed in the cavity portion, a second connection recess is formed in a portion of the face member facing the first connection recess, and a fixing member is arranged between the first and the second connection recesses, and the fixing member is plastically deformed so as to be pressed into the first and the second connection recesses, to thereby secure the face member to the head body. By fitting the face member into the cavity portion on the head body, and reliably securing a desired location in the cavity portion to a desired location in the face member, the head body and the face member which comprise different materials can be reliably secured together.

According to the fourth embodiment of the present invention, there is provided a method of manufacturing a golfing iron club with a head provided with a face on a front surface and a shaft connecting portion on one side, and a shaft connected to the shaft connecting portion, the head comprising a head body formed with a sole, a cavity portion corresponding to the face formed in a front surface, a window opening formed inside the cavity portion and passing through to a rear surface side and a face member formed from a plate-like metallic material and fitted into the cavity portion. A first connection recess is formed in the cavity portion, a second connection recess is formed in a portion of the face member facing the first connection recess, and the face member is pressed into the cavity portion. At the time of the pressing, a fixing billet is arranged between the first and the second connection recesses and the fixing billet is plastically deformed so as to be pressed into the first and the second connection recesses, to thereby secure the face member to the head body. Since the fixing billet is plastically deformed at the time of pressingly inserting the face member into the cavity portion, so as to be fitted into the first and the second connection recesses, the head body and the face member comprising different materials can be reliably secured by a single operation.

What is claimed is:

1. A golf club comprising:

a head having a face on a front surface and a shaft connecting portion on one side;

a shaft connected to said shaft connecting portion;

said head comprising a head body having a sole, a cavity portion opening to said face formed in said front surface, a window opening formed inside said cavity portion and passing through to a rear surface of said head body and a face member arranged at least partially in said cavity portion;

a bottom portion of said head body on a side of said cavity portion including said sole being deeply gouged into an undercut shape to thereby form a protrusion on a front part of said bottom portion;

a front face of said protrusion including at least one first connection recess;

said face member including at least one second connection recess formed in a portion facing said at least one first connection recess; and said head further comprising a fixing member plastically deformed and pressed into said at least one first connection recess and said at least one second connection recess to thereby secure said face member to said head body.

2. A golf club according to claim 1, wherein at least one of said at least one first connection recess and said at least one second connection recess has a peripheral face formed in a reverse tapered shape so that at least one of the longitudinal width and the lateral width gradually expands toward a bottom of the recess.

3. A golf club according to claim 1, wherein a peripheral face of at least one of said at least one first connection recess and said at least one second connection recess includes irregularities.

4. A golf club according to claim 3, wherein said at least one first connection recess and said at least one second connection recess are formed with a female thread.

5. A golf club according to claim 4, wherein said fixing member is made of material which has a smaller Young's modulus than the Young's modulus of said head body or of said face member.

6. A golf club according to claim 5, wherein said at least one first connection recess comprises two recesses arranged on left and right sides of said front face of said protrusion.

7. A golf club according to claim 1, wherein said at least one first connection recess and said at least one second connection recess are formed with a female thread.

8. A golf club according to claim 1, wherein said fixing member is made of material which has a smaller Young's modulus than the Young's modulus of said head body or of said face member.

9. A golf club according to claim 1, wherein said at least one first connection recess comprises two recesses arranged on left and right sides of said front face of said protrusion.

10. A method of manufacturing a golf club with a head provided with a face on a front surface and a shaft connecting portion on one side, and a shaft connected to said shaft connecting portion, said head comprising a head body having a sole, a cavity portion opening to said face formed in said front surface, a window opening formed inside said cavity portion and passing through to a rear surface of said head body and a face member arranged at least partially in said cavity portion, the method comprising the steps of:

deeply gouging a bottom portion of said head body on a side of said cavity portion including said sole into an undercut shape to thereby form a protrusion on a front part of said bottom portion;

forming at least one first connection recess on a front face of said protrusion;

forming at least one second connection recess on a rear face portion of said face member facing said at least one first connection recess;

arranging a plastically deformable fixing billet between said at least one first connection recess and said at least one second connection recess; and pressing said face member into said cavity portion such that said fixing billet is plastically deformed and pressed into said at least one first connection recess and said at least one second connection recess to thereby secure said face member to said head body.

11. A method of manufacturing a golf club according to claim 10, further comprising the step of forming said at least one first connection recess and said at least one second connection recess with a female thread.

12. A golf club head comprising:

a head body having a front surface, a rear surface, a shaft connecting portion, a sole and a cavity extending from said front surface to said rear surface, a bottom portion of said head body on a side of said cavity including said sole being deeply gouged into an undercut shape to thereby form a protrusion on a front part of said bottom portion, said protrusion dividing only a portion of said cavity into a cavity portion adjacent said front surface of said head body and a window opening adjacent said rear surface such that a remaining portion of said cavity extends from said front surface to said rear surface, a front face of said protrusion including a first connection recess;

a face member arranged at least partially in said cavity portion and including a second connection recess formed in a rear face facing said first connection recess; and a fixing member arranged in said first connection recess and said second connection recess to thereby secure said face member to said head body.

13. A golf club head according to claim 12, wherein said fixing member is made of a plastically deformable material.

14. A golf club head according to claim 12, wherein at least one of said first connection recess and said second connection recess has a peripheral face formed in a reverse tapered shape so that at least one of the longitudinal width and the lateral width gradually expands toward a bottom of the recess.

15. A golf club head according to claim 12, wherein a peripheral face of at least one of said first connection recess and said second connection recess includes irregularities.

16. A golf club head according to claim 12, wherein said first connection recess and said second connection recess are formed with a female thread.

17. A golf club head according to claim 12, wherein said fixing member is made of material which has a smaller Young's modulus than the Young's modulus of said head body or of said face member.

* * * * *